US009297558B2

(12) United States Patent
Choi et al.

(10) Patent No.: US 9,297,558 B2
(45) Date of Patent: Mar. 29, 2016

(54) REFRIGERATING SYSTEM

(75) Inventors: Jae Heuk Choi, Seoul (KR); Yoon Ho Yoo, Seoul (KR); Do Yong Ha, Seoul (KR); Baik Young Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1747 days.

(21) Appl. No.: 12/727,341

(22) Filed: Mar. 19, 2010

(65) Prior Publication Data

US 2011/0120158 A1 May 26, 2011

(30) Foreign Application Priority Data

Nov. 20, 2009 (KR) ..... 10-2009-0112363

(51) Int. Cl.

| | |
|---|---|
| ***F25B 41/00*** | (2006.01) |
| ***F25B 7/00*** | (2006.01) |
| ***F25B 13/00*** | (2006.01) |
| ***F25D 11/00*** | (2006.01) |
| ***F25B 1/10*** | (2006.01) |
| ***F25B 41/04*** | (2006.01) |

(52) U.S. Cl.

CPC . *F25B 7/00* (2013.01); *F25B 41/04* (2013.01); *F25B 13/00* (2013.01); *F25B 2400/06* (2013.01)

(58) Field of Classification Search

CPC ..... F25B 7/00; F25B 13/00; F25B 41/00; F25B 29/003; F25B 5/04; F25B 5/00; F25B 2400/0417; F25B 2600/2501; F25D 5/02; F25D 11/02

USPC ..... 62/79, 113, 160, 175, 196.3, 197, 198, 62/199, 222, 223, 324.1, 324.6, 441, 498, 62/513

See application file for complete search history.

(56) References Cited

U.S. PATENT DOCUMENTS

| | | | | |
|---|---|---|---|---|
| 6,298,683 | B1 * | 10/2001 | Kondo et al. | 62/335 |
| 6,405,554 | B1 * | 6/2002 | Kawakatu et al. | 62/335 |
| 7,231,774 | B2 * | 6/2007 | Taras et al. | 62/176.5 |
| 2004/0050093 | A1 | 3/2004 | Lifson | |

FOREIGN PATENT DOCUMENTS

| | | |
|---|---|---|
| EP | 1 059 494 | 12/2000 |
| EP | 1 865 268 | 12/2007 |
| JP | 58-66762 | 4/1983 |
| JP | 58-69379 A | 4/1983 |
| JP | 2003-283500 | 10/2003 |
| JP | 2004-360999 | 12/2004 |

(Continued)

OTHER PUBLICATIONS

Korean Office Action issued in KR Application No. 10-2009-0112363 dated Jul. 19, 2011.

(Continued)

*Primary Examiner* — M. Alexandra Elve
*Assistant Examiner* — Henry Crenshaw
(74) *Attorney, Agent, or Firm* — Ked & Associates, LLP

(57) ABSTRACT

A refrigerating system including an air conditioning system and a cooler system is provided. An air conditioner-side refrigerant passage may be connected to a cooler-side refrigerant passage to allow refrigerant to flow between the air conditioning system and the cooler system. Thus, if a cooler-side compressor experiences abnormal operation, cooler-side refrigerant may be compressed by an air conditioner-side compressor so as to maintain cooling performance of the refrigerating system.

12 Claims, 13 Drawing Sheets

(56) References Cited

FOREIGN PATENT DOCUMENTS

| | | |
|---|---|---|
| JP | 2005-221194 | 8/2005 |
| JP | 2007-240040 | 9/2007 |
| WO | WO 2005/108886 | 11/2005 |

OTHER PUBLICATIONS

European Search Report issued in EP Application No. EP 10153396.6 dated Mar. 16, 2011.

Korean Notice of Allowance issued in Application No. 10-2009-0112363 dated Mar. 21, 2012.

* cited by examiner

REFRIGERATING SYSTEM

This claims priority to Korean Patent Application No. 10-2009-0112363, filed in Korea on Nov. 20, 2009, the entirety of which is incorporated herein by reference.

BACKGROUND

1. Field

This relates to a refrigerating system.

2. Background

Generally, refrigerating systems perform a refrigerant cycle including compression-condensation-expansion-evaporation to cool or heat an indoor space or store food in a refrigerated or frozen state. Such a refrigerating system may include a compressor for compressing refrigerant, an indoor heat exchanger in which the refrigerant is heat-exchanged with indoor air, an expansion part for expanding the refrigerant, and an outdoor heat exchanger in which the refrigerant is heat-exchanged with outdoor air. Such a refrigerant system may also include an accumulator for separating gaseous refrigerant from liquid refrigerant, a four-way valve for changing a flow direction of the refrigerant, a fan for blowing the indoor air or the outdoor air toward the indoor heat exchanger or the outdoor heat exchanger, and a motor for rotating the fan.

When an indoor cooling operation is performed, the indoor heat exchanger may serve as an evaporator, and the outdoor heat exchanger may serve as a condenser. When an indoor heating operation is performed, the indoor heat exchanger may serve as the condenser, and the outdoor heat exchanger may serve as the evaporator. The four-way valve may change the flow direction of the refrigerant to switch between the heating and cooling operations.

DETAILED DESCRIPTION OF THE EMBODIMENTS

Figure 1:
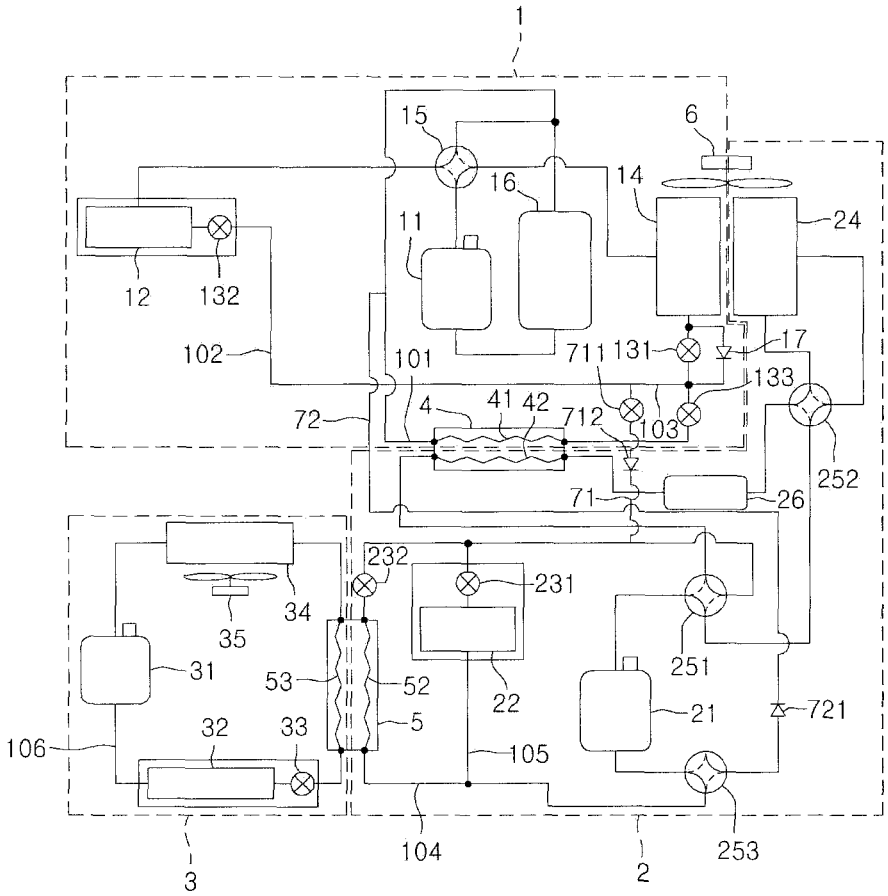
FIG. 1 is a circuit diagram of a refrigerant system according to a first embodiment as broadly described herein.

As shown in FIG. 1, a refrigerating system in accordance with a first embodiment as broadly described herein may include an air conditioner 1 that performs a refrigerant cycle to air-condition indoor air, and coolers 2 and 3 that perform the refrigerant cycle to cool storage items, such, as for example, perishable food items. In certain embodiments, the coolers 2 and 3 may include a refrigerator 2 for storing perishable or non-perishable items in a refrigerated state and a freezer 3 for storing perishable or non-perishable items in a frozen state.

The air conditioner 1 may include an air conditioner-side compressor 11 for compressing refrigerant flowing into the air conditioner 1, an air conditioner-side outdoor heat exchanger 14 in which the refrigerant is heat-exchanged with outdoor air, air conditioner-side expansion devices, or parts, 131, 132, and 133 for expanding the refrigerant, and an indoor heat exchanger 12 in which the refrigerant is heat-exchanged with indoor air. The air conditioner 1 may also include an accumulator 16 for separating out gaseous refrigerant from liquid refrigerant in the refrigerant introduced into the air conditioner-side compressor 11, and a four-way valve 15 for changing a flow direction of the refrigerant discharged from the air conditioner-side compressor 11.

The refrigerator 2 may include a refrigerator-side compressor 21 for compressing refrigerant flowing into the refrigerator 2, a refrigerator-side outdoor heat exchanger 24 in which the refrigerant is heat-exchanged with the outdoor air, refrigerator-side expansion devices, or parts, 231 and 232 for expanding the refrigerant, and a refrigerating heat exchanger 22 in which the refrigerant and perishable items are heat-exchanged with adjacent air.

The freezer 3 may include a freezer-side compressor 31 for compressing refrigerant flowing into the freezer 3, a freezer-side outdoor heat exchanger 34 in which the refrigerant is heat-exchanged with the outdoor air, a fan motor assembly 35 for forcedly blowing the outdoor air toward the outdoor heat exchanger 34, a freezer-side expansion device, or part, 33 for expanding the refrigerant, and a freezing heat exchanger 32 in which the refrigerant and perishable items are heat-exchanged with adjacent air.

The coolers 2 and 3 may respectively include a cooler-side compressor for compressing refrigerant flowing into the coolers 2 and 3, a cooler-side outdoor heat exchanger in which the refrigerant is heat-exchanged with the outdoor air, a cooler-side expansion device, or part, for expanding the refrigerant, and a cooling heat exchanger in which the refrigerant and foods are heat-exchanged with adjacent air. The cooler-side compressor may include the refrigerator-side compressor 21 and the freezer-side compressor 31. The cooler-side outdoor heat exchanger may include the refrigerator-side outdoor heat exchanger 24 and the freezer-side outdoor heat exchanger 34. The cooler-side expansion device, or part, may include the refrigerator-side expansion devices, or parts, 231 and 232 and the freezer-side expansion device, or part, 33. The cooling heat exchanger may include the refrigerating heat exchanger 22 and the freezing heat exchanger 32.

Various devices, such as, for example, a solenoid valve, that can adjust an opening and closing of a refrigerant control valve, expansion of the refrigerant, and a flow amount of the refrigerant, may be used as the air conditioner-side expansion devices, or parts, 131, 132, and 133, the refrigerator-side expansion devices, or parts, 231 and 232, and the freezer-side expansion device, or part, 33.

The refrigerant system may include a fan motor assembly 6 for forcedly blowing the outdoor air toward the air conditioner-side outdoor heat exchanger 14 and the refrigerator-side outdoor heat exchanger 24. When the air conditioner-side outdoor heat exchanger 14 is positioned substantially adjacent to the refrigerator-side outdoor heat exchanger 24, one fan motor assembly 6 may be provided to blow the outdoor air toward the air conditioner-side outdoor heat exchanger 14 as well as the refrigerator-side outdoor heat exchanger 24. On the other hand, when the air conditioner-side outdoor heat exchanger 14 is spaced apart from the refrigerator-side outdoor heat exchanger 24, two fan motor assemblies respectively corresponding to the air conditioner-side outdoor heat exchanger 14 and the refrigerator-side outdoor heat exchanger 24 may be provided.

The refrigerating system may include refrigerant heat exchangers 4 and 5 for heat-exchange between the refrigerator 2 and the freezer 3. In detail, the refrigerant heat exchangers 4 and 5 may include a first refrigerant heat exchanger 4 for heat-exchange between the refrigerant of the air conditioner 1 and the refrigerant of the refrigerator 2 and a second refrigerant heat exchanger 5 for heat exchanger between the refrigerant of the refrigerator 2 and the refrigerant of the freezer 3.

Two flow paths 41 and 42 may be disposed within the first refrigerant heat exchanger 4 to allow the refrigerant of the air conditioner 1 and the refrigerant of the refrigerator 2 to be heat-exchanged with each other while the refrigerant of the air conditioner 1 and the refrigerant of the refrigerator 2 independently flow. Also, two flow paths 52 and 53 may be disposed within the second refrigerant heat exchanger 5 to allow the refrigerant of the refrigerator 2 and the refrigerant of the freezer 3 to be heat-exchanged with each other while the refrigerant of the refrigerator 2 and the refrigerant of the freezer 3 independently flow.

The first refrigerant heat exchanger 4 may be connected in parallel to the indoor heat exchanger 12 on the air conditioner 1. In detail, the air conditioner 1 may also include air conditioner-side refrigerant tubes 101, 102, and 103 for guiding a refrigerant flow of the air conditioner 1. The air conditioner-side refrigerant tubes 101, 102, and 103 include a first refrigerant tube 101, a second refrigerant tube 102, and a detour tube 103. The first refrigerant tube 101 connects the compressor, the air conditioner-side outdoor heat exchanger 14 and the first refrigerant heat exchanger 4 to each other. The second refrigerant tube 102 guides the refrigerant discharged from the air conditioner-side compressor 11 or the refrigerant discharged from the outdoor heat exchanger to the indoor heat exchanger 12.

A detour tube 103 may be connected in parallel to a third expansion part 131 to be described later. That is, the second refrigerant tube 102 may have one end connected to a portion of the first refrigerant tube 101 between the air conditioner-side outdoor heat exchanger 14 and the indoor heat exchanger 12 and the other end connected to another portion of the first refrigerant tube 101 between the indoor heat exchanger 12 and the air conditioner-side compressor 11. The detour tube 103 has one end connected to the first refrigerant tube 101 between the air conditioner-side outdoor heat exchanger 14 and the third expansion part 131, and the other end connected to the first refrigerant tube 101 between the third expansion part 131 and the first refrigerant heat exchanger 4.

A flow restrictor 17 for restricting a refrigerant flow passing through the detour tube 103 to a certain direction is disposed in the detour tube 103. In detail, the flow restrictor 17 prevents refrigerant flowing from the indoor heat exchanger 12 toward the air conditioner-side outdoor heat exchanger 14 from passing through the detour tube 103. Thus, the refrigerant flowing from the indoor heat exchanger 12 toward the air conditioner-side outdoor heat exchanger 14 passes through the third expansion part 131. Various devices, such as, for example, a check valve that can restrict the flow direction of the refrigerant to a certain direction, may be used for the flow restrictor 17.

The air conditioner-side expansion parts 131, 132, and 133 may include a first expansion part 132, a second expansion part 133, and a third expansion part 131. The first expansion part 132 is disposed in the first refrigerant tube 101 corresponding to an inlet side of the indoor heat exchanger 12. The second expansion part 133 is disposed in the second refrigerant tube 102 corresponding to an inlet side of the refrigerant heat exchangers 4 and 5. The third expansion part 131 is disposed in the first refrigerant tube 101 adjacent to the air conditioner-side outdoor heat exchanger 14. The air conditioner-side expansion parts 131, 132, and 133 may adjust opening degrees of the air conditioner-side refrigerant tubes 101 and 102, and simultaneously, selectively close the air conditioner-side refrigerant tubes 101 and 102. In detail, the first expansion part 132 may adjust an amount of refrigerant introduced into the indoor heat exchanger 12, and simultaneously, may selectively interrupt the flow of refrigerant toward the indoor heat exchanger 12. The second expansion part 133 may adjust an amount of refrigerant introduced into the refrigerant heat exchanger 4 and 5, and simultaneously, may selectively interrupt the flow of refrigerant toward the refrigerant heat exchanger 4 and 5. The third expansion part 131 may expand the refrigerant introduced into the air conditioner-side outdoor heat exchanger 14 or interrupt flow through the first refrigerant tube 101 to detour the refrigerant passing through the air conditioner-side heat exchanger 14 around the third expansion part 131.

The second refrigerant heat exchanger 5 may be connected in parallel to the refrigerating heat exchanger 22 on the refrigerator 2. In detail, the refrigerator 2 may also include refrigerator-side refrigerant tubes 104 and 105 for guiding the refrigerant flowing into the refrigerator 2. The refrigerator-side refrigerant tubes 104 and 105 include a third refrigerant tube 104 and a fourth refrigerant tube 105, respectively. The third refrigerant tube 104 connects the refrigerator-side compressor, the refrigerator-side outdoor heat exchanger 24, and the second refrigerant heat exchanger 5 to each other. The fourth refrigerant tube 105 guides a portion of the refrigerant introduced into the second refrigerant heat exchanger 5 to the refrigerating heat exchanger 22. That is, the fourth refrigerant tube 105 has one end connected to a portion of the third refrigerant tube 104 between the refrigerator-side compressor 21 and the refrigerating heat exchanger 22, and the other end connected to another portion of the third refrigerant tube 104 between the refrigerator-side outdoor heat exchanger 24 and the refrigerant heat exchangers 4 and 5.

The second refrigerant heat exchanger 5 may be connected to the freezing heat exchanger 32 in series on the freezer 3. In detail, the second refrigerant heat exchanger 5 may also include a freezer-side refrigerant tube 106 for guiding the refrigerant flowing into the freezer 3. The freezer-side refrigerant tube 106 sequentially connects the freezer-side compressor 31, the freezer-side outdoor heat exchanger 34, the second refrigerant heat exchanger 5, the freezer-side expansion part 33, and the freezer-side heat exchanger 32 to each other.

The coolers 2 and 3 may include cooler-side refrigerant tubes 104 and 105 for guiding the refrigerant flowing into the coolers 2 and 3. The cooler-side refrigerant tubes 104 and 105 include the refrigerator-side refrigerant tubes 104 and 105 and the freezer-side refrigerant tube 106.

The refrigerator-side expansion parts 231 and 232 may include the fourth expansion part 232 disposed in the third refrigerant tube 104 corresponding to the inlet side of the second refrigerant heat exchanger 5, and the fifth expansion part 231 disposed in the fourth refrigerant tube 105 corresponding to the inlet side of the refrigerating heat exchanger 22.

The refrigerator 2 may include flow switching devices, or parts, 251, 252, and 253 for switching a flow direction of the refrigerant flowing into the refrigerator 2. The flow switching devices, or parts, 251, 252, and 253 may include a first flow switching part 251 for switching a flow direction of the refrigerant discharged from the refrigerator-side compressor 21 toward the refrigerant heat exchangers 4 and 5 or the refrigerator-side outdoor heat exchanger 24, a second flow switching part 252 for selectively interrupting the refrigerant flow flowing toward the refrigerator-side outdoor heat exchanger 24, and a third flow switching part 253 for selectively introducing the refrigerant of the coolers 2 and 3 into a second connection tube 72 (to be described later).

In detail, the refrigerant discharged from the refrigerator-side compressor 21 may sequentially flow into the refrigerator-side outdoor heat exchanger 24 and the first refrigerant heat exchanger 4, or may sequentially flow into the first refrigerant heat exchanger 4 and the refrigerator-side outdoor heat exchanger 24, based on a change of the flow direction due to the first flow switching part 251. The refrigerant discharged from the refrigerator-side compressor 21 or the first refrigerant heat exchanger 4 may be introduced into the refrigerator-side outdoor heat exchanger 24 or directly introduced into the first refrigerant heat exchanger 4 or the refrigerating heat exchanger 22 without passing through the refrigerator-side outdoor heat exchanger 24 according to a change of the flow direction due to the second flow switching part 252. The refrigerant passing through the refrigerating heat exchanger 22 or the second refrigerant heat exchanger 5 may be introduced into the refrigerator-side compressor 21 or the second connection tube 72.

Various devices, such as, for example, the four-way valve 15 that can selectively switch the flow direction of the refrigerant in four different directions, may be used as the flow switching devices, parts, 251, 252, and 253.

The refrigerating system may also include connection tubes 71 and 72 connecting the air conditioner-side refrigerant tubes 101, 102, and 103 to the cooler-side refrigerant tubes 104 and 105 to allow the refrigerant to flow between the air conditioner 1 and the coolers 2 and 3. The connection tubes 71 and 72 include a first connection tube 71 and a second connection tube 72. The refrigerant of the air conditioner 1 flows into the coolers 2 and 3 through the first connection tube 71. The refrigerant of the coolers 2 and 3 flow into the air conditioner 1 through the second connection tube 72.

In detail, the air conditioner refrigerant tube 101 and the refrigerator-side refrigerant tube 104 are connected through the connection tubes 71 and 72 such that the refrigerant flows between the air conditioner 1 and the refrigerator 2. In certain embodiments, the connection tubes 71 and 72 include a first connection tube 71 through which the refrigerant of the air conditioner 1 flows into the refrigerator 2 and a second connection tube 72 through which the refrigerant of the refrigerator 2 flows into the air conditioner 1.

The first connection tube 71 has one end connected to a portion of the air conditioner-side refrigerant tube 101 between the air conditioner-side outdoor heat exchanger 14 and the indoor heat exchanger 12 and the other end connected to a portion of the refrigerator-side refrigerant tube 104 corresponding to the inlet side of the refrigerating heat exchanger 22. The second connection tube 72 has one end connected to another portion of the refrigerator-side refrigerant tube 104 between the refrigerating heat exchanger 22 and the refrigerator-side compressor 21 and the other end connected to another portion of the air conditioner-side refrigerant tube 101 corresponding to the inlet side of the air conditioner-side compressor 11.

A flow interruptor 711 for selectively interrupting the refrigerant flow through the connection tubes 71 and 72 is disposed in the connection tubes 71 and 72. In detail, the flow interruptor 711 is disposed in the first connection tube 71. The refrigerant flow through the first connection tube 71 may be selectively prevented based on an opening or closing of the flow interruptor 711.

Flow restrictors 712 and 721 for restricting the refrigerant flow through the connection tubes 71 and 72 in a certain direction are disposed in the connection tubes 71 and 72. In detail, the flow restrictors 712 and 721 include a first flow restriction part 712 disposed in the first connection tube 71 and a second flow restriction part 721 disposed in the second connection tube 72. The first flow restriction part 712 restricts the refrigerant of the refrigerator 2 from flowing toward the air conditioner 1. The second flow restriction part 721 restricts the refrigerant of the air conditioner 1 from flowing toward the refrigerator 2. That is, the refrigerant of the refrigerator 2 may not flow into the air conditioner 1 through the first connection tube 71 due to the first flow restriction part 712, and the refrigerant of the air conditioner 1 may not flow into the refrigerator 2 through the second connection tube 72 due to the second flow restriction part 721.

Various devices, such as, for example, a check valve that can restrict refrigerant flow in a certain direction, may be used as the flow restrictors 712 and 721.

The flow switching part 253 may be switched into a first state in which a closed circuit of a refrigerant cycle including the refrigerator-side compressor 21 is formed, or into a second state in which a closed circuit of a refrigerant cycle including the air conditioner-side compressor 11.

In detail, when the flow switching part 253 is in the first state, the refrigerator-side refrigerant tubes 104 and 105 corresponding to an outlet side of the refrigerating heat exchanger 22 and the second refrigerant heat exchanger 5 communicate with the refrigerator-side refrigerant tubes 104 and 105 corresponding to an inlet side of the refrigerator-side compressor 21. Thus, a closed circuit refrigerant cycle including the refrigerator-side compressor 21, the refrigerator-side outdoor heat exchanger 24, the first refrigerant heat exchanger 4, the refrigerator-side expansion parts 231 and 232, the refrigerating heat exchanger 22, and the second refrigerant heat exchanger 5 is formed.

When the flow switching part 253 is in the second state, the refrigerator-side refrigerant tubes 104 and 105 corresponding to an outlet side of the refrigerating heat exchanger 22 and the second refrigerant heat exchanger 5 communicate with the second connection tube 72. Thus, a closed circuit refrigerant cycle including the air conditioner-side compressor 11, the air conditioner-side outdoor heat exchanger 14, the refrigerator-side expansion parts 231 and 232, the refrigerating heat exchanger 22, and the second refrigerant heat exchanger 5 is formed.

Hereinafter, a refrigerant flow when the refrigerating system is operated in a cooling mode will be described in detail with reference to accompanying drawings.

Figure 2:
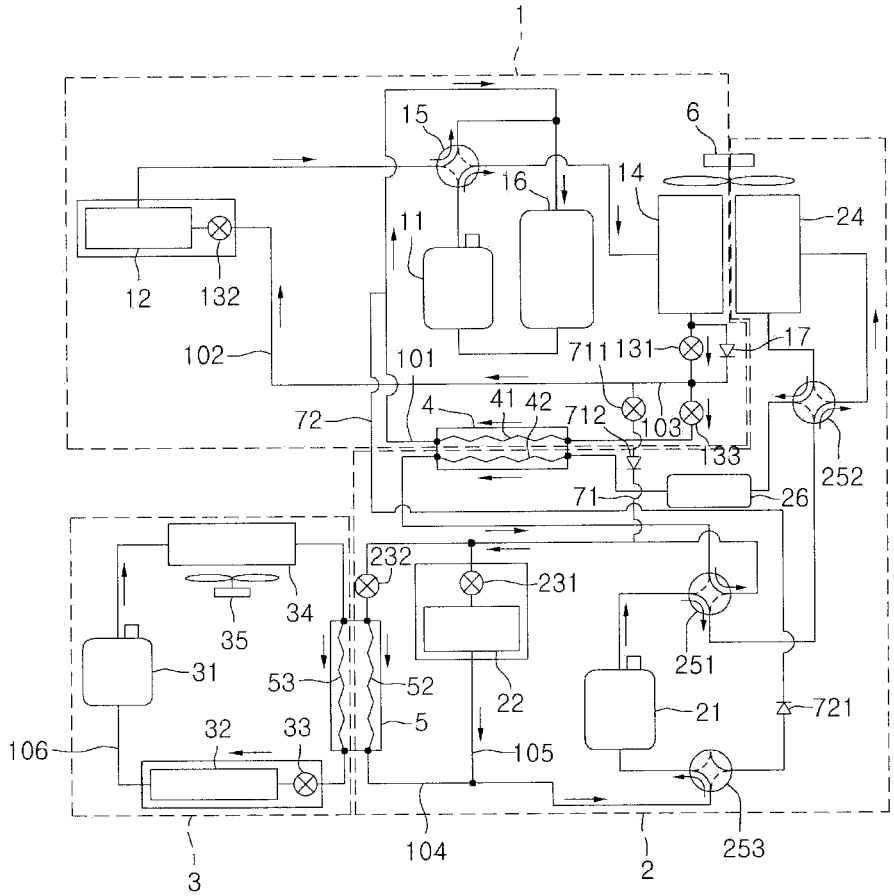
FIG. 2 illustrates a refrigerant flow in a state where the refrigerating system shown in FIG. 1 is operated in a cooling mode.

Referring to FIG. 2, refrigerant flow in the air conditioner 1 when the refrigerating system is operated in a normal cooling mode will be described. The high-temperature high-pressure refrigerant discharged from the air conditioner-side compressor 11 is introduced into the air conditioner-side outdoor heat exchanger 114. The four-way valve 15, which is disposed between the air conditioner-side compressor 11 and the air conditioner outdoor heat exchanger 14, guides a flow direction of the refrigerant such that the refrigerant discharged from the air conditioner-side compressor 11 flows toward the air conditioner-side outdoor heat exchanger 14.

When the refrigerant flows into the air conditioner outdoor heat exchanger 14, the refrigerant radiates heat to the indoor air, and thus, the refrigerant is condensed in a low-temperature low-pressure state. The refrigerant passing through the air conditioner-side outdoor heat exchanger 14 is expanded in the low-temperature low-pressure state while the refrigerant passes through the first expansion part 132. At this time, the third expansion part 131 is maintained in the closed circuit condition to introduce the refrigerant passing through the air conditioner-side outdoor heat exchanger 14 into the first expansion part 132 through the detour tube 103.

The refrigerant passing through the first expansion part 132 is introduced into the indoor heat exchanger 12, the refrigerant absorbs heat from the indoor air, and thus is evaporated in a high-temperature low-pressure state. The refrigerant passing through the indoor heat exchanger 12 is introduced into the accumulator 16. The four-way valve 15, which is disposed between the indoor heat exchanger 12 and the accumulator 16, guides the flow direction of the refrigerant such that the refrigerant is introduced into the accumulator 16. When the refrigerant passes through the accumulator 16, the liquid refrigerant is filtered, and only the gaseous refrigerant is introduced again into the air conditioner-side compressor 11. When the refrigerant passes through the air conditioner-side compressor 11, the refrigerant is compressed at a high-temperature and high-pressure. When the refrigerant continuously flows as described above, the indoor space may be cooled.

Hereinafter, the refrigerant flow within the refrigerator 2 will be described. The high-temperature high-pressure refrigerant discharged from the refrigerator-side compressor 21 passes through the refrigerator-side outdoor heat exchanger 24 and the first refrigerant heat exchanger 4. The refrigerant discharged from the refrigerator-side compressor 21 may sequentially or reversely flow into the refrigerator-side outdoor heat exchanger 24 and the first refrigerant heat exchanger 4 based on a change of the flow direction due to the first flow switching part 251. Also, the refrigerant discharged from the refrigerator-side compressor 21 may be introduced into the refrigerator-side outdoor heat exchanger 24, or may be directly introduced into the first refrigerant heat exchanger 4 or the refrigerating heat exchanger 22, without passing through the refrigerator-side outdoor heat exchanger 24 based on a change of the flow direction due to the second flow switching part 252.

When the refrigerant passes through at least one of the refrigerator-side outdoor heat exchanger 24 and the first refrigerant heat exchanger 4, the refrigerant is condensed in a low-temperature high-pressure state. In detail, when the refrigerant passes through the refrigerator-side outdoor heat exchanger 24, the refrigerant radiates heat to the outdoor air. When the refrigerant passes through the first refrigerant heat exchanger 4, the refrigerant within the refrigerator 2 radiates heat to the refrigerant of the air conditioner 1. Thus, the refrigerant is condensed in a low-temperature high-pressure state.

When the refrigerant passes through all of the refrigerator-side outdoor heat exchanger 24 and the first refrigerant heat exchanger 4, the refrigerant is overcooled, and is in a relatively low temperature state when compared to the refrigerant that passes through one of the refrigerator-side outdoor heat exchanger 24 or the first refrigerant heat exchanger 4. Thus, when the refrigerant passes through all of the refrigerator-side outdoor heat exchanger 24 and the first refrigerant heat exchanger 4, the coefficient of performance (COP) of the refrigerator 2 is relatively high compared to when the refrigerant passes through only the refrigerator-side outdoor heat exchanger 24.

The refrigerant passing through at least one of the refrigerator-side outdoor heat exchanger 24 or the first refrigerant heat exchanger 4 is introduced into the refrigerator-side expansion parts 231 and 232. In detail, the refrigerant passing through at least one of the refrigerator-side outdoor heat exchanger 24 or the first refrigerant heat exchanger 4 is introduced into the fourth expansion part 232 and the fifth expansion part 231, and is expanded in a low-temperature low-pressure state.

The refrigerant passing through the fourth expansion part 232 is introduced into the second refrigerant heat exchanger 5, and the refrigerant passing through the fifth expansion part 231 is introduced into the refrigerating heat exchanger 22. That is, the refrigerant passing through the refrigerator-side expansion parts 231 and 232 is introduced into the second refrigerant heat exchanger 5 and the refrigerating heat exchanger 22. When the refrigerant passes through the second refrigerant heat exchanger 5, the refrigerant within the refrigerator 2 absorbs heat from the freezer 3, and thus is evaporated in a high-temperature low-pressure state. When refrigerant passes through the refrigerating heat exchanger 22, the refrigerant absorbs heat of air adjacent to the refrigerating heat exchanger 22, and thus is evaporated in a high-temperature low-pressure state.

The refrigerant passing through the second refrigerant heat exchanger 5 and the refrigerating heat exchanger 22 flows toward the refrigerator-side compressor 21. When the refrigerant passes through the refrigerator-side compressor 21, the refrigerant is condensed in a high-temperature high-pressure state.

The third flow switching part 253 guides the flow direction of the refrigerant such that the refrigerant passing through the refrigerating heat exchanger 22 flows toward the refrigerator-side compressor 21.

Refrigerant flow within freezer 3 will now be described. The high-temperature high-pressure refrigerant discharged from the freezer-side compressor 31 is introduced into the freezer-side outdoor heat exchanger 34. The refrigerant radiates heat to the outdoor air, and thus is condensed in a low-temperature high-pressure state.

The refrigerant passing through the freezer-side outdoor heat exchanger 34 is introduced into the second refrigerant heat exchanger 5. When the refrigerant passes through the second refrigerant heat exchanger 5, the refrigerant within the freezer 3 radiates heat to the refrigerant of the refrigerator 2, and thus is condensed in a low-temperature low-pressure state.

When the refrigerant passes through all of the freezer-side outdoor heat exchanger 34 and the second refrigerant heat exchanger 5, the refrigerant is overcooled, and is in relatively low temperature state when compared to the refrigerant that passes through one of the freezer-side outdoor heat exchanger 34 or the second refrigerant heat exchanger 5. Thus, when the refrigerant passes through all of the freezer-side outdoor heat exchanger 34 and the second refrigerant heat exchanger 5, the coefficient of performance (COP) of the freezer 3 is relatively high compared to when the refrigerant passes through only the freezer-side outdoor heat exchanger 34.

The refrigerant passing through the second refrigerant heat exchanger 5 is introduced into the freezer-side expansion part 33, and the refrigerant is expanded in a low temperature low-pressure state. The refrigerant passing through the freezer-side expansion part 33 is introduced into the freezing heat exchanger 32, the refrigerant absorbs heat from air adjacent to the freezing heat exchanger 32, and thus is evaporated in a high-temperature low-pressure state.

The refrigerant passing through the freezing heat exchanger 32 is condensed again in a high-temperature high-pressure state while the refrigerant passes through the freezer-side compressor 31.

Hereinafter, a refrigerant flow when the refrigerating system is operated in a heating mode will now be described in detail with reference to accompanying drawings. In the heating mode, the refrigerator 2 and the freezer 3 have substantially the same refrigerant flow as in the cooling mode, but a refrigerant flow within the air conditioner 1 is different.

Figure 3:
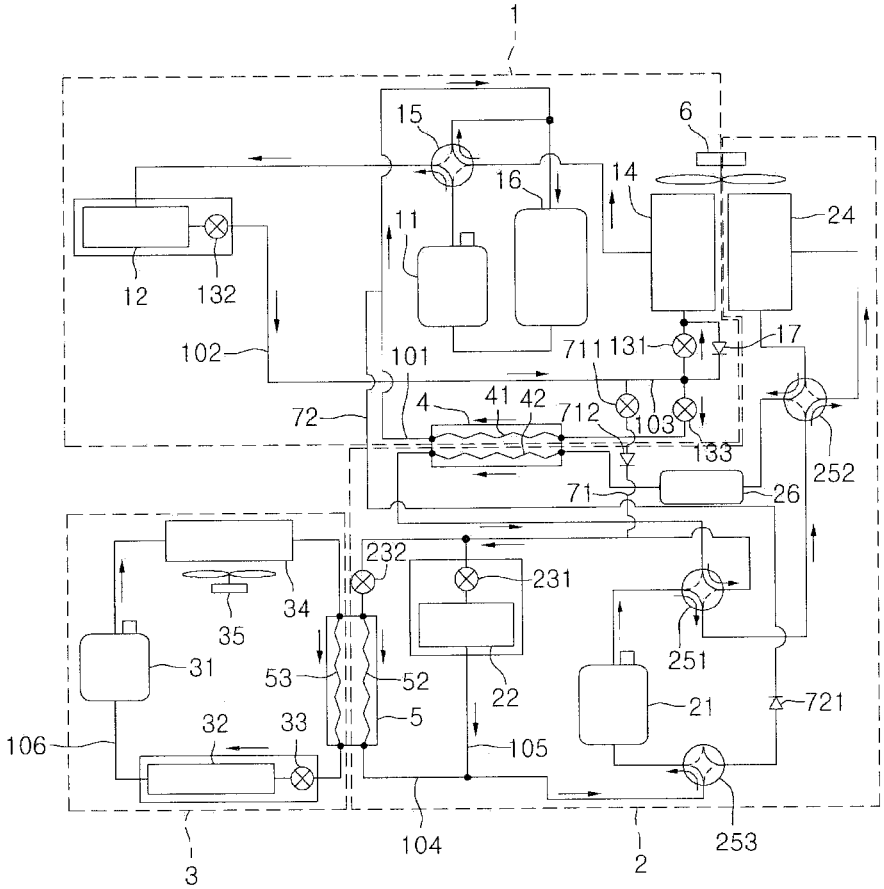
FIG. 3 illustrates a refrigerant flow in a state where the refrigerating system shown in FIG. 1 is operated in a heating mode.

Referring to FIG. 3, when the refrigerating system is operated in a normal heating mode, the refrigerant discharged from the air conditioner-side compressor 11 is introduced into the indoor heat exchanger 12. The four-way valve 15 guides a flow direction of the refrigerant such that the refrigerant discharged from the air conditioner-side compressor 11 flows toward the indoor heat exchanger 12.

When the refrigerant passes through the indoor heat exchanger 12, the refrigerant radiates heat to the indoor air, and thus, the refrigerant is condensed in a low-temperature high-pressure state. The refrigerant flows from the indoor heat exchanger 12 into the third expansion part 131 due to the flow restriction part 17, because the refrigerant does not pass through the detour tube 103. The third expansion part 131 is maintained in a completely opened state to substantially expand the refrigerant at the third expansion part 131. That is, when the refrigerant passes through the third expansion part 131, the refrigerant is expanded in a low-temperature low-pressure state.

The refrigerant passing through the third expansion part 131 is introduced into the air conditioner-side outdoor heat exchanger 14. When the refrigerant passes through the air conditioner-side outdoor heat exchanger 14, the refrigerant absorbs heat from the outdoor air, and thus is evaporated in a high-temperature low-pressure state.

The refrigerant discharged from the air conditioner-side outdoor heat exchanger 14 is introduced into the accumulator 16 to filter the liquid refrigerant from the gaseous refrigerant. The four-way valve 15 guides a flow direction of the refrigerant such that the refrigerant discharged from the air conditioner-side outdoor heat exchanger 14 is introduced toward the accumulator 16. Only the gaseous refrigerant filtered by the accumulator 16 is introduced into the air conditioner-side compressor 11, and thus is condensed again in a high-temperature high-pressure state. When the refrigerant continuously flows as described above, the indoor space may be heated.

Hereinafter, a refrigerant flow when the refrigerating system is operated in a back-up mode will now be described in detail with reference to accompanying drawings.

Figure 4:
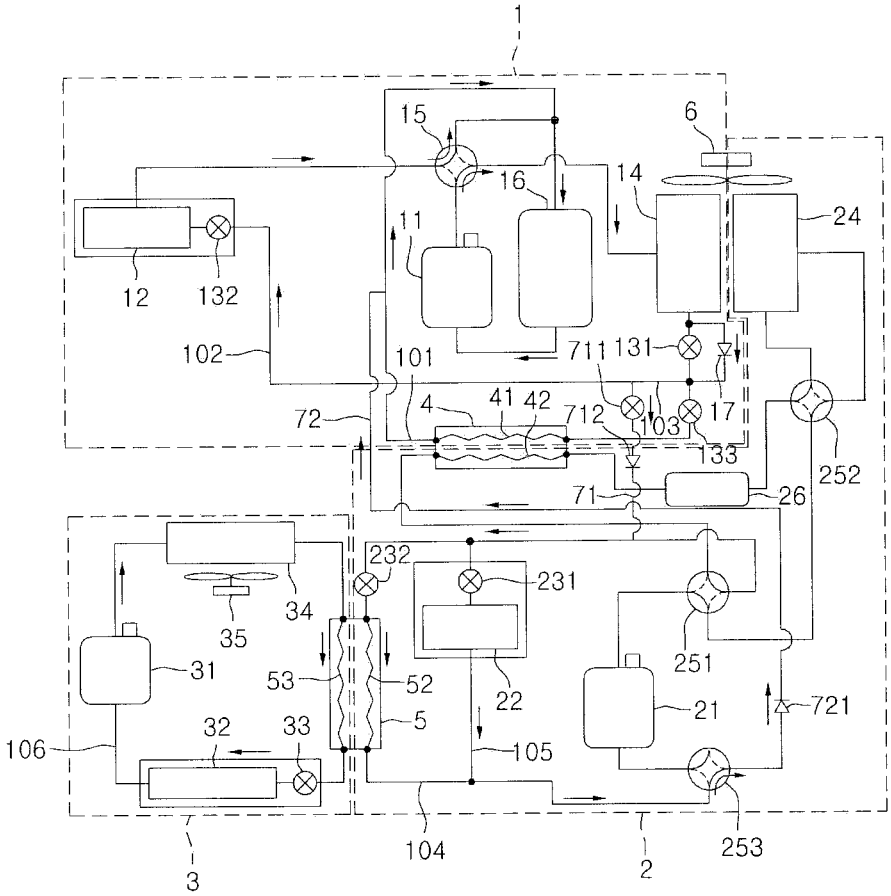
FIG. 4 illustrates a refrigerant flow in a state where the refrigerating system shown in FIG. 1 is operated in a back-up mode while the refrigerant system cools an indoor space.
Figure 5:
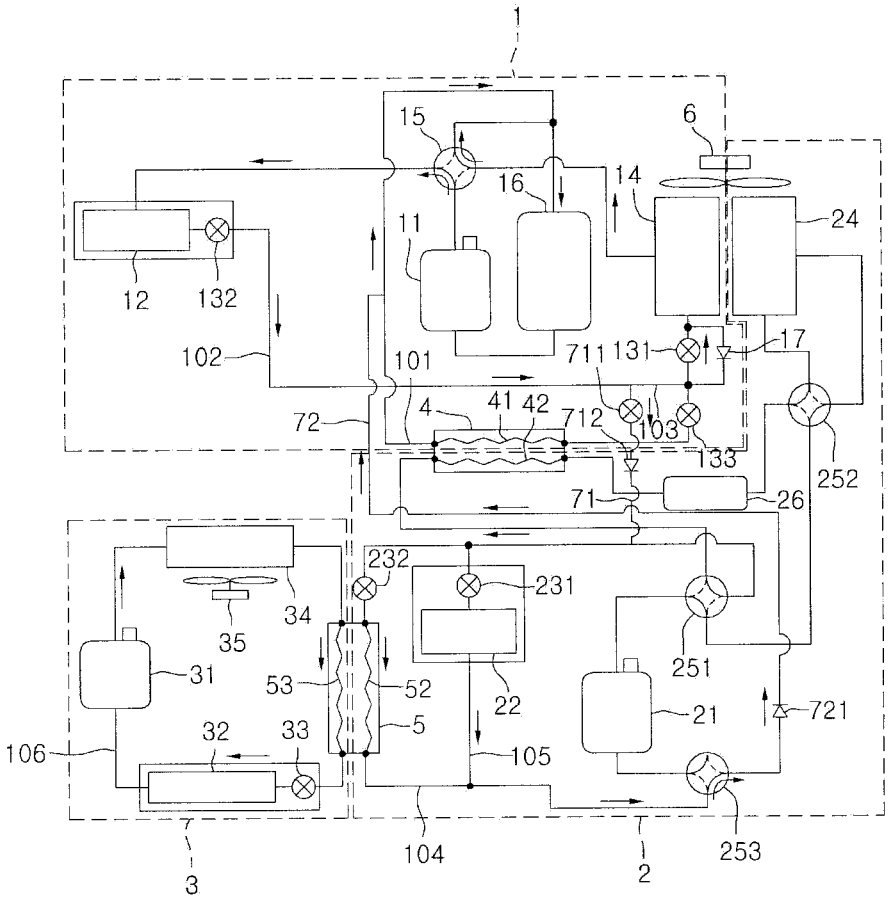
FIG. 5 illustrates a refrigerant flow in a state where the refrigerating system shown in FIG. 1 is operated in the back-up mode while the refrigerating system heats the indoor space.

Referring to the refrigerating system shown in FIGS. 4 and 5, it is understood that the refrigerator-side compressor 21 may malfunction, and thus the refrigerator 2 may be abnormally operated, possibly causing spoilage of perishable items stored in the refrigerator 2. In this case, the air conditioner-side compressor 11, instead of the refrigerator-side compressor 21, may be used to normally operate the refrigerator 2. Such an operation state may be referred to herein after as a back-up mode. Refrigerant flow when the refrigerating system is operated in the back-up mode will now be described.

When the refrigerating system is operated in the back-up mode, the flow interruption part 711 is opened, and a flow direction of the refrigerant is changed by the third flow switching part 253. In detail, since the flow interruption part 711 is opened, a portion of the low-temperature high-pressure refrigerant discharged from the air conditioner-side outdoor heat exchanger 14 and the indoor heat exchanger 12 is introduced into the first connection tube 71. Although the flow interruption part 711 is opened, the refrigerant flow from the refrigerator 2 toward the air conditioner 1 through the first connection tube 71 is restricted by the first flow restriction part 712. Thus, the refrigerant within the first connection tube 71 may flow from the air conditioner 1 only toward the refrigerator 2.

The refrigerant passing through the connection tubes 71 and 72 is introduced into the fourth expansion part 232 and the fifth expansion part 231, and is expanded in a low-temperature low-pressure state. The refrigerant passing through the fourth expansion part 232 is introduced into the second refrigerant heat exchanger 5, and the refrigerant passing through the fifth expansion part 231 is introduced into the refrigerating heat exchanger 22. When the refrigerant passes through the refrigerating heat exchanger 22 and the second refrigerant heat exchanger 5, the refrigerant is evaporated in a high-temperature low-pressure state.

The refrigerant passing through the refrigerating heat exchanger 22 and the second refrigerant heat exchanger 5 is introduced into the third flow switching part 253. The third flow switching part 253 guides a flow direction of the refrigerant such that the refrigerant passing through the refrigerating heat exchanger 22 and the second refrigerant heat exchanger 5 flows into the second connection tube 72. That is, the flow direction is switched by the third flow switching part 253 when compared to the manner in which the refrigerating system is normally operated.

Although the refrigerator-side refrigerant tube 104 and the air conditioner-side refrigerant tube 101 communicate with each other, the refrigerant within the second connection tube 72 flows from the refrigerator 2 toward the air conditioner 1 due to the third flow switching part 253. This is done because the refrigerant flow from the air conditioner 1 toward the refrigerator 2 through the second connection tube 72 is restricted by the second flow restriction part 721.

The refrigerant introduced into the second connection tube 72 flows into the first refrigerant tube 101 corresponding to the inlet side of the air conditioner-side compressor 11 to which an end of the second connection tube 72 is connected. The refrigerant is compressed again at a high-temperature high-pressure while the refrigerant passes through the air conditioner-side compressor 11 along the first refrigerant tube 101.

In the case in which the refrigerating system is operated in the back-up mode, the air conditioner 1 has substantially the same refrigerant flow as that of the air conditioner 1 when the refrigerating system is normally operated. That is, although the refrigerant system is operated in the back-up mode, the air conditioner 1 may be operated in the normal cooling or heating mode.

A case in which the refrigerating system is operated in the back-up mode while an indoor space is cooled by the air conditioner 1 is illustrated FIG. 4. A case in which the refrigerating system is operated in the back-up mode while the indoor space is heated by the air conditioner 1 is illustrated in FIG. 5. Unlike when the refrigerating system is normally operated, in the back-up mode, the connection tubes 71 and 72 are opened by the flow interruption part 711 and the third flow switching part 253, and the refrigerant within the refrigerator 2 is compressed and forced to flow by the air conditioner-side compressor 11.

In the backup mode, even if the refrigerator-side compressor 21 malfunctions or an operation thereof is stopped, cooling performance of the refrigerator 2 may be maintained. For example, if the refrigerator-side compressor 21 malfunctions or the operation thereof is stopped due to a break down, the flow interruption part 711 and the flow switching part 253 may be operated to open the connection tubes 71 and 72. Thus, the refrigerant within the refrigerator 2 may flow into the air conditioner-side compressor 11 to be compressed and then returned to the refrigerator 2, and the cooling cycle of the refrigerator 2 may be normally performed by the air conditioner-side compressor 11. Therefore, the performance of the refrigerating system may be effectively maintained.

Hereinafter, a refrigerant flow when the refrigerating system is operated in a non air-conditioning mode will be described in detail with reference to accompanying drawings.

Figure 6:
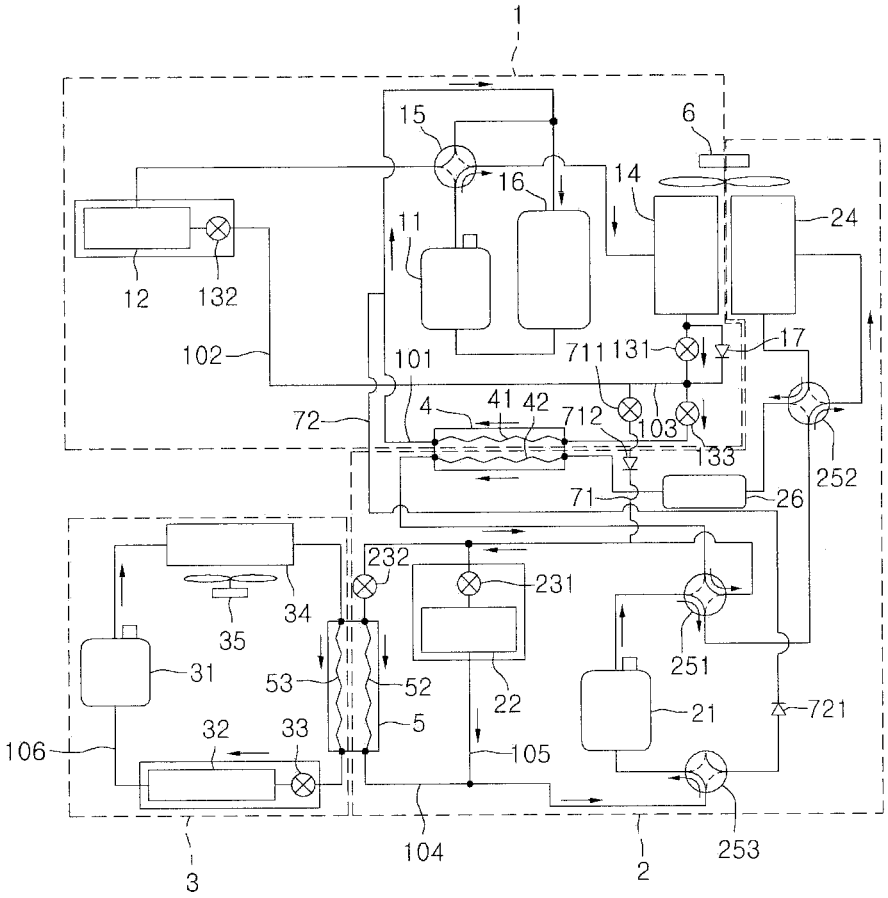
FIG. 6 illustrates a refrigerant flow in a state where the refrigerating system shown in is operated in a non air-conditioning mode.

Referring to the refrigerating system shown in FIG. 6, in some instances, the air conditioner 1 may not be used. For example, cooling or heating of an indoor space may not be required during spring and autumn. However, the refrigerator 2 and freezer 3 that store perishable items would continue to be continuously operated. Such an operation state may be referred to as a non air-conditioning mode.

When the refrigerating system is operated in the non air-conditioning mode, the refrigerant flow toward the indoor heat exchanger 12 is interrupted. In detail, the first expansion part 132 is closed to interrupt the refrigerant discharged from the air conditioner-side compressor 11 or the air conditioner-side outdoor heat exchanger 14 from flowing toward the indoor heat exchanger 12. Thus, the high-temperature high-pressure refrigerant discharged from the air conditioner-side compressor 11 flows into the air conditioner-side outdoor heat exchanger 14. The four-way valve 15 guides a flow direction such that the refrigerant discharged from the air conditioner-side compressor 11 flows into the air conditioner-side outdoor heat exchanger 14.

When the refrigerant passes through the air conditioner-side outdoor heat exchanger 14, the refrigerant radiates heat to the outdoor air, and thus is condensed in a low-temperature high-pressure state. The refrigerant passing through the air conditioner-side outdoor heat exchanger 14 is introduced into the second expansion part 133. Since the third expansion part 131 is closed, the refrigerant passing through the air conditioner-side outdoor heat exchanger 14 is introduced into the second expansion part 133 through the detour tube 103.

When the refrigerant passes through the second expansion part 133, the refrigerant is expanded in a low-temperature low-pressure state, and is then introduced into the first refrigerant heat exchanger 4. When the refrigerant passes through the first refrigerant heat exchanger 4, the refrigerant within the air conditioner 1 absorbs heat from the refrigerant of the refrigerator 2, and thus is evaporated in a high-temperature low-pressure state. When the refrigerant passing through the first refrigerant heat exchanger 4 passes through the accumulator 16, the liquid refrigerant is separated from the gaseous refrigerant, and only the gaseous refrigerant is introduced into the air conditioner-side compressor 11.

When the refrigerant system is operated in the non air-conditioning mode, the refrigerator 2 and the freezer 3 have substantially the same refrigerant flow as when the refrigerating system is operated in the cooling or heating mode.

A coefficient of performance (COP) of the refrigerating system may be even higher when compared to the case in which refrigerant passes through only the refrigerator-side outdoor heat exchanger 24. In detail, the refrigerant passing through both the refrigerator-side outdoor heat exchanger 24 and the first refrigerant heat exchanger 4 may have a temperature less than that of the refrigerant passing through only the refrigerator-side outdoor heat exchanger 24. That is, since the refrigerant additionally passes through the first refrigerant heat exchanger 4, the refrigerant may overcooled. As a result, an amount of heat absorbed by the refrigerant passing through the second refrigerant heat exchanger 5 and the freezing heat exchanger 22 may be further increased. Thus, the COP of the refrigerating system may be further improved.

The COP of the refrigerating system is in proportion to the cooling performance of the refrigerating system. Thus, as a COP value increases, the cooling performance of the refrigerating system increases. Therefore, the refrigerating system may have further improved cooling performance when compared to the case in which refrigerant within the refrigerator 2 passes through only the refrigerator-side outdoor heat exchanger 24.

Hereinafter, a refrigerant system according to another embodiment will be described in detail with reference to the accompanying drawings. This embodiment is different from the first embodiment, in that the third flow switching part 253 is provided as an open/close valve.

Figure 7:
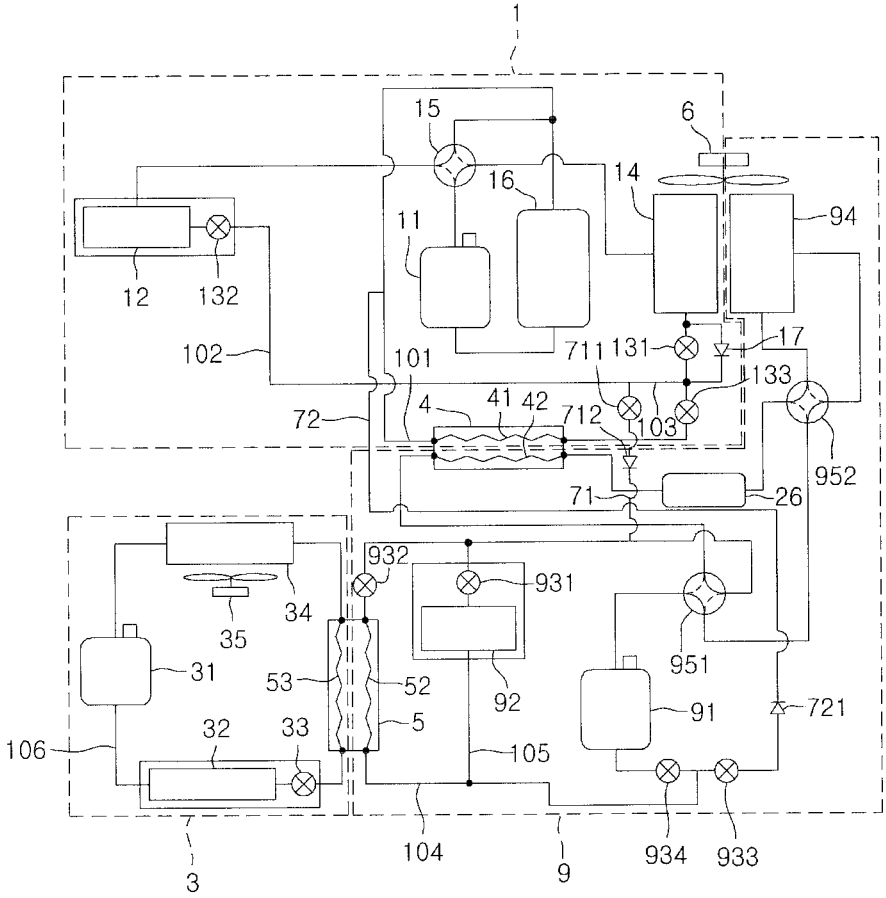
FIG. 7 is a circuit diagram of a refrigerating system according to a second embodiment as broadly described herein.
Figure 8:
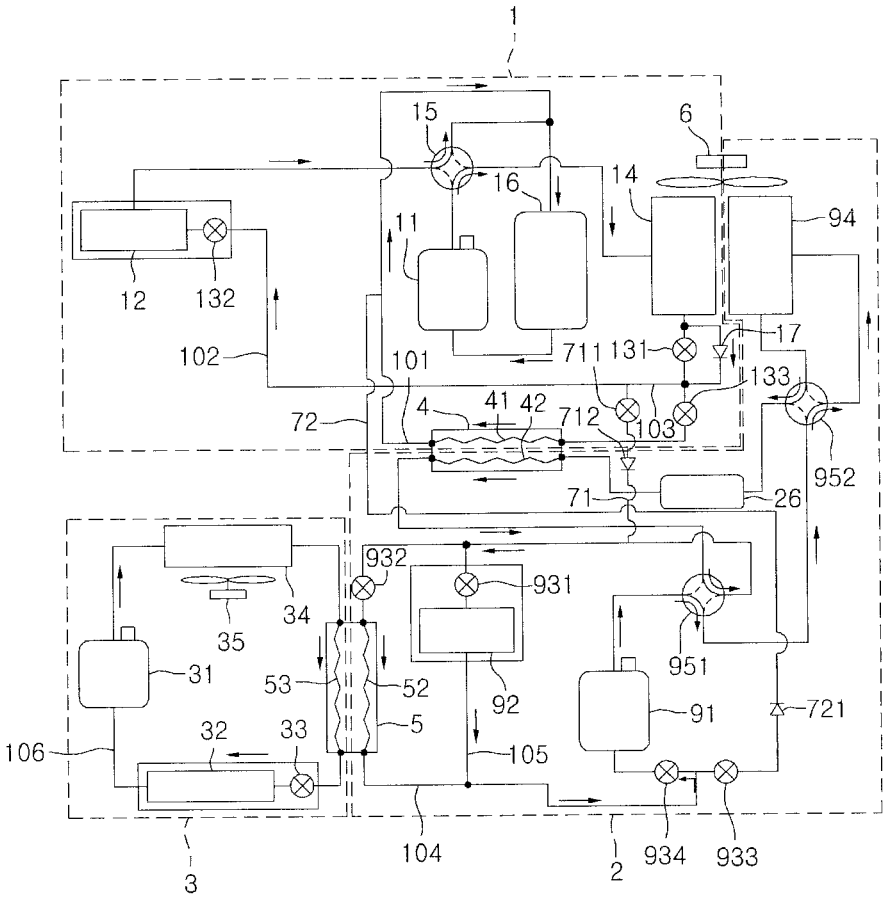
FIG. 8 illustrates a refrigerant flow in a state where the refrigerating system shown in FIG. 7 is operated in a cooling mode.
Figure 9:
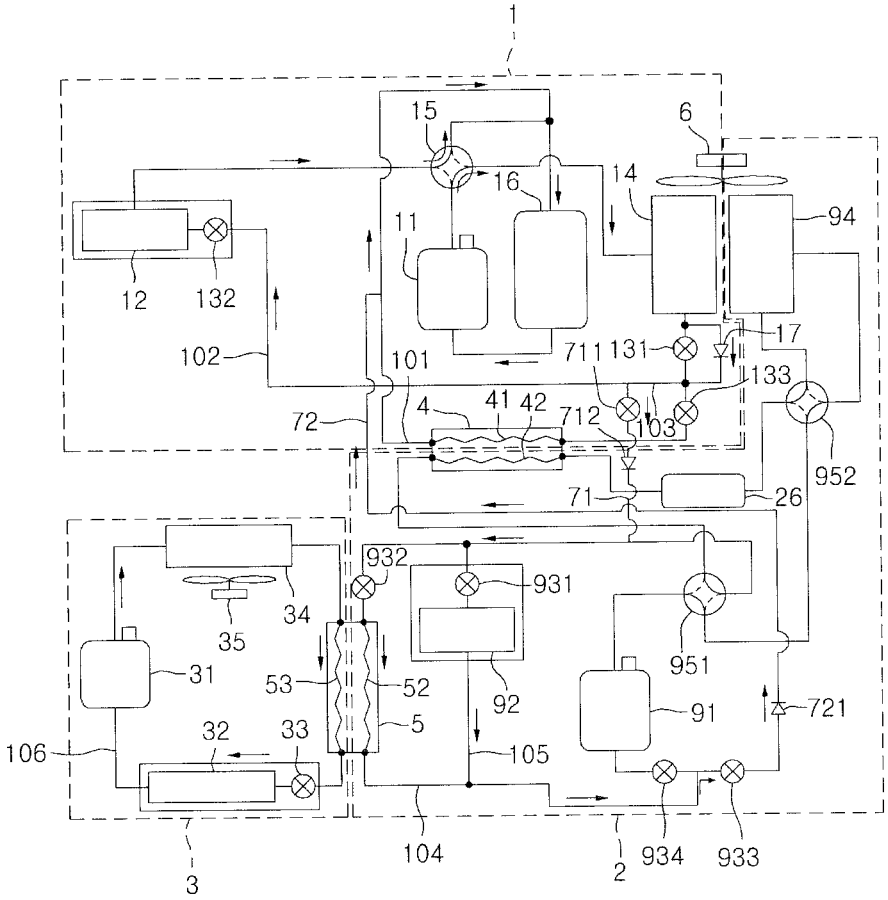
FIG. 9 illustrates a refrigerant flow in a state where the refrigerating system shown in FIG. 7 is operated in a back-up mode while the refrigerating system cools an indoor space.

FIG. 7 is a diagram of a refrigerating system according to another embodiment as broadly described herein, and FIG. 8 illustrates refrigerant flow when the refrigerating system is operated in a cooling mode. FIG. 9 illustrates refrigerant flow when the refrigerating system is operated in a back-up mode while the refrigerating system cools an indoor space.

In detail, the open/close valve may include a first open/close valve 934 for opening or closing a refrigerant flow passage toward a refrigerator-side compressor 21, and a second open/close valve 933 for opening or closing a refrigerant flow passage toward a second connection tube 72. The first open/close valve 934 corresponds to an outlet side of a refrigerating heat exchanger 22 and a second refrigerant heat exchanger 5. The first open/close valve 934 is disposed in a refrigerator-side refrigerant tube 104 corresponding to an inlet side of the refrigerator-side compressor 21. The second open/close valve 933 is disposed in the second connection tube 72.

The refrigerant discharged from the refrigerating heat exchanger 22 and the second refrigerant heat exchanger 5 may flow into the refrigerator-side compressor 21 or the second connection tube 72 according to opening/closing of the first and second open/close valves 933 and 934.

In detail, when the refrigerating system is normally operated, the first open/close valve 934 is opened, and the second open/close valve 933 is closed. Thus, the refrigerant discharged from the refrigerating heat exchanger 22 and the second refrigerant heat exchanger 5 flows into the refrigerator-side compressor 21.

When the refrigerant system is operated in a back-up mode, the second open/close valve 933 is opened, and the first open/ close valve 934 is closed. Thus, the refrigerant discharged from the refrigerating heat exchanger 22 and the second refrigerant heat exchanger 5 flows into the second connection tube 72.

Hereinafter, a refrigerating system according to another embodiment will be described in detail with reference to the accompanying drawings. This embodiment is different from the first embodiment in that an air conditioner-side compressor performs and maintains a refrigerant cycle of a freezer when operation of a freezer-side compressor is stopped.

Figure 10:
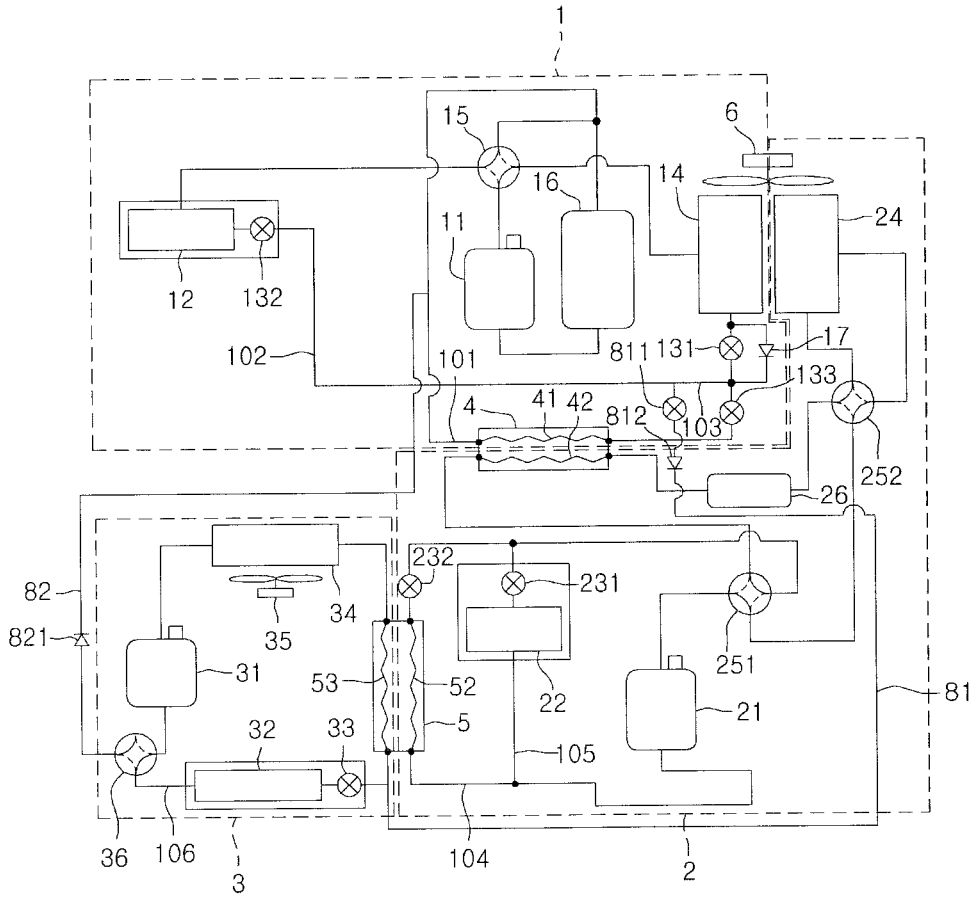
FIG. 10 is a circuit diagram of a refrigerating system according to a third embodiment as broadly described herein.
Figure 11:
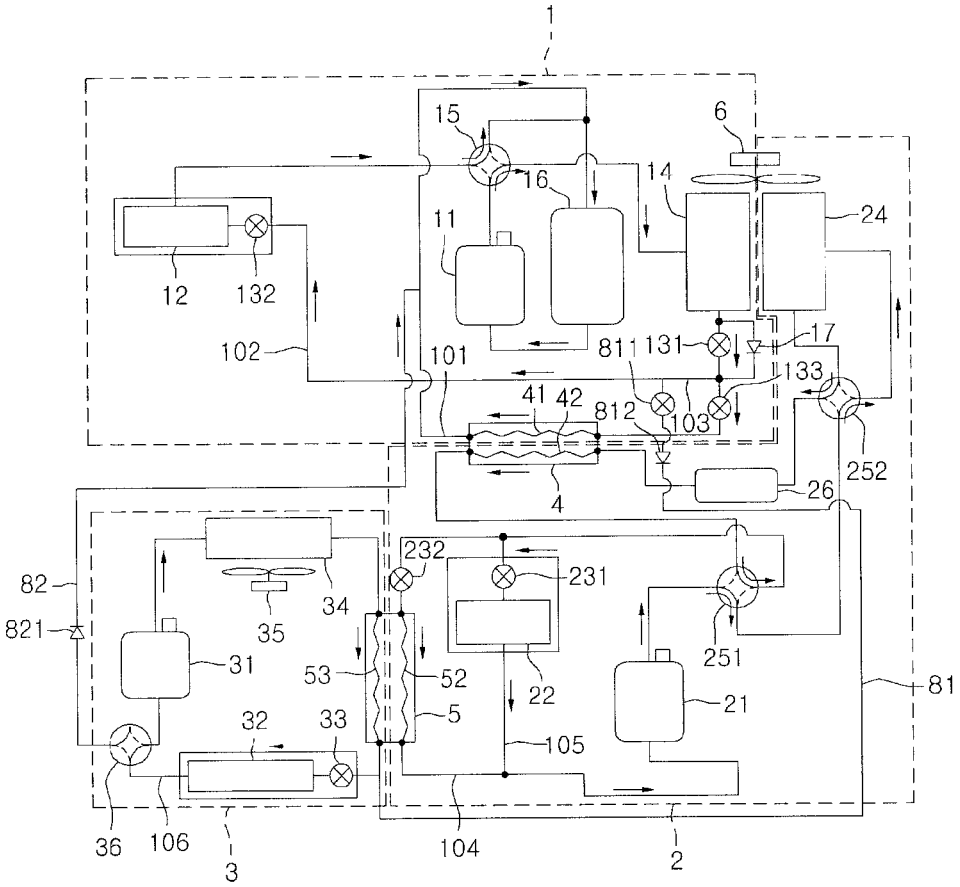
FIG. 11 illustrates a refrigerant flow in a state where the refrigerating system shown in FIG. 10 is operated in a cooling mode.
Figure 12:
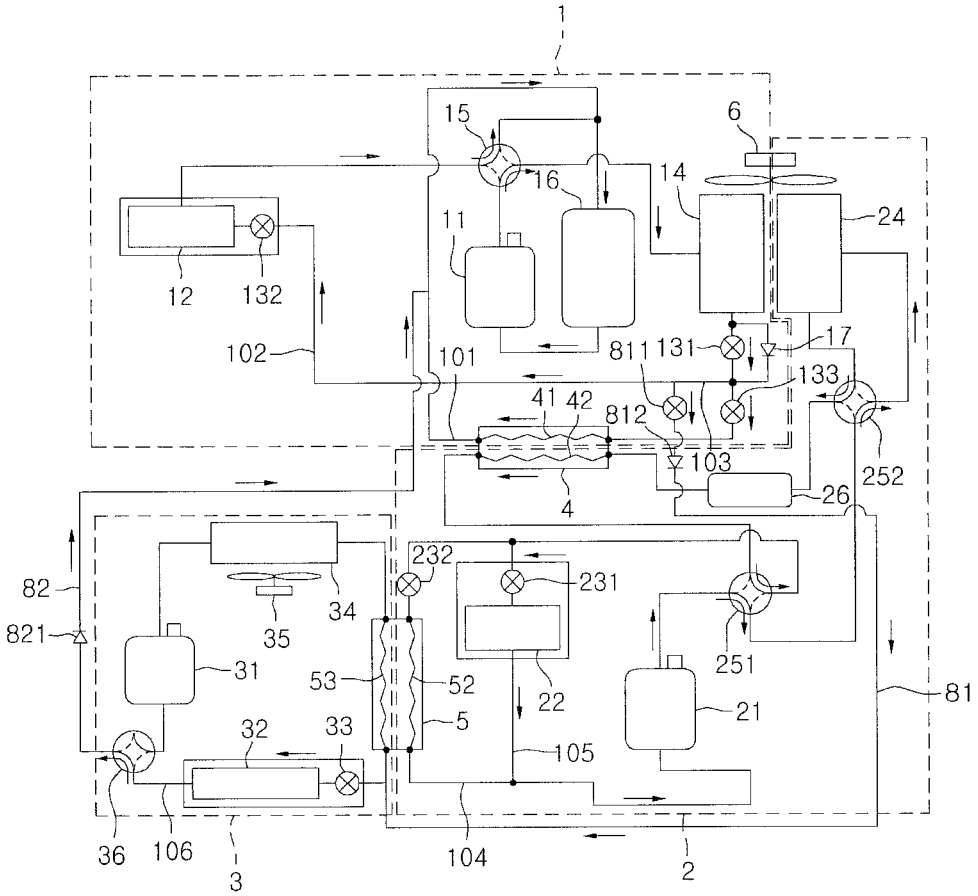
FIG. 12 illustrates a refrigerant flow in a state where the refrigerating system shown in FIG. 10 is operated in the back-up mode while the refrigerating system cools the indoor space.

FIG. 10 is a diagram of a refrigerating system according to another embodiment as broadly described herein. FIG. 11 illustrates refrigerant flow when the refrigerating system is operated in a cooling mode. FIG. 12 illustrates refrigerant flow when the refrigerating system is operated in the back-up mode while also cooling an indoor space.

Referring to the refrigerating system shown FIGS. 10 to 12, although an operation of a freezer-side compressor 31 is stopped, refrigerant within a freezer 3 may be compressed or forcedly flow by an air conditioner-side compressor 11 to perform and maintain a refrigerant cycle of the freezer 3.

In detail, the refrigerating system may include connection tubes 81 and 82 connecting an air conditioner 1 to coolers 2 and 3 to allow the refrigerant to flow between the air conditioner 1 and the coolers 2 and 3. In more detail, the coolers 2 and 3 include a refrigerator 2 for performing a refrigerant cycle to store perishable items in a refrigerated state and a freezer 3 for performing the refrigerant cycle to store perishable items in a frozen state.

The connection tubes 81 and 82 connect the air conditioner 1 to the freezer 3 such that refrigerant flows between the air conditioner 1 and the freezer 3. The connection tubes 81 and 82 include a first connection tube 81 for guiding the refrigerant within the air conditioner 1 to the freezer 3 and a second connection tube 82 for guiding the refrigerant within the freezer 3 to the air conditioner 1. That is, the first connection tube 81 connects a portion of air conditioner-side refrigerant tubes 101 and 102 corresponding to an outlet side of an air conditioner-side outdoor heat exchanger 14 to a portion of a freezer-side refrigerant tube 106 corresponding to an inlet side of a freezing heat exchanger 32. The second connection tube 82 connects another portion of the freezer-side refrigerant tube 106 corresponding to an outlet side of the freezing heat exchanger 32 to another portion of the air conditioner-side refrigerant tubes 101 and 102 corresponding to an inlet side of an air conditioner-side compressor 11.

The first connection tubes 81 and 82 respectively include a flow interruption part 811 for selectively interrupting the refrigerant flow within the first connection tube 81 and a flow restriction part 812 for restricting a refrigerant flow direction within the first connection tube 81 toward the freezer 3. The second connection tube 82 includes a second flow restriction part 821 for restricting a refrigerant flow direction within the second connection tube 82 toward the air conditioner 1.

The freezer 3 includes a flow switching part 36 for selectively preventing the refrigerant from flowing toward the freezer-side compressor 31. The flow switching part 36 is switched into one of a first state, in which a closed circuit of a refrigerant cycle including the freezer-side compressor 31 is formed, and a second state, in which a closed circuit of a refrigerant cycle including the air conditioner-side compressor 11 is formed. The flow switching part 36 in the first state is illustrated in FIG. 11, and the flow switching part 36 in the second state is illustrated in FIG. 12.

In detail, when the flow switching part 36 is in the first state, since the freezer-side refrigerant tube 106 corresponding to an outlet side of the freezing heat exchanger 32 communicates with the freezer-side refrigerant tube 106 corresponding to an inlet side of the freezer-side compressor 31, the closed circuit refrigerant cycle including the freezer-side compressor 31, a freezer-side outdoor heat exchanger 34, the second refrigerant heat exchanger 5, a freezer-side expansion part 33, and a freezing heat exchanger 32 is formed.

When the flow switching part 36 is in the second state, since the freezer-side refrigerant tube 106 corresponding to an outlet side of the freezing heat exchanger 32 communicates with the second connection tube 82, the closed circuit refrigerant cycle including the air conditioner-side compressor 11, an air conditioner-side outdoor heat exchanger 14, a freezer-side expansion part 33, and a freezing heat exchanger 32 is formed.

Hereinafter, the refrigerant flow within the refrigerating system will be described in detail.

Referring to FIG. 11, in a cooling mode, the refrigerating system has substantially the same refrigerant flow as that of the refrigerating system that is normally operated in the cooling mode.

Referring to FIG. 12, due to a malfunction or an operation stop of the freezer-side compressor 31 during operation of the refrigerating system, an operation of the freezer 3 may be stopped. In this case, the air conditioner-side compressor 11 may perform the refrigerant cycle of the freezer 3 to continuously perform and maintain the refrigerant cycle of the freezer 3. Such an operation state may be hereinafter referred to as the back-up mode.

When the refrigerating system is operated in the back-up mode, the high-temperature high-pressure refrigerant discharged from the air conditioner-side compressor 11 is condensed in a low-temperature high-pressure state while the refrigerant passes through the air conditioner-side outdoor heat exchanger 14. A portion of the refrigerant passing through the air conditioner-side outdoor heat exchanger 14 flows along the first connection tube 81.

Although at this point the flow interruption part 811 is opened, the refrigerant within the first connection tube 81 may flow only toward the freezer 3 because the first flow restriction part 812 restricts the refrigerant flow within the first connection tube 81 toward the freezer 3.

The refrigerant flowing along the first connection tube 81 is introduced into the freezer-side expansion part 33, and the refrigerant is expanded in a low-temperature low-pressure state. The refrigerant passing through the freezer-side expansion part 33 is evaporated in a high-temperature low-pressure state while the refrigerant passes through the freezing heat exchanger 32.

The refrigerant passing through the freezing heat exchanger 32 is introduced into the second connection tube 82. Because the flow switching part 36 is in the second state, the refrigerant discharged from the freezing heat exchanger 32 may be introduced into the second connection tube 82. Thus, due to the flow switching part 36, although the freezer-side refrigerant tube 106 corresponding to an outlet side of the freezing heat exchanger 32 communicates with the second connection tube 82, the refrigerant within the second connection tube 82 may flow only toward the air conditioner 1 because the second flow restriction part 821 restricts the refrigerant flow within the second connection tube 82 toward the air conditioner 1.

The refrigerant passing through the second connection tube 82 passes through an accumulator 16, and the flows back into the air conditioner-side compressor 11.

When the freezer-side compressor 31 malfunctions or an operation of the freezer-side compressor 31 is stopped, the above-described processes may be continuously performed to maintain the cooling performance of the refrigerator 2 and/or freezer 3, i.e., the overall cooling performance of the refrigerating system.

Hereinafter, a method of operating a refrigerating system will be described in detail.

Figure 13:
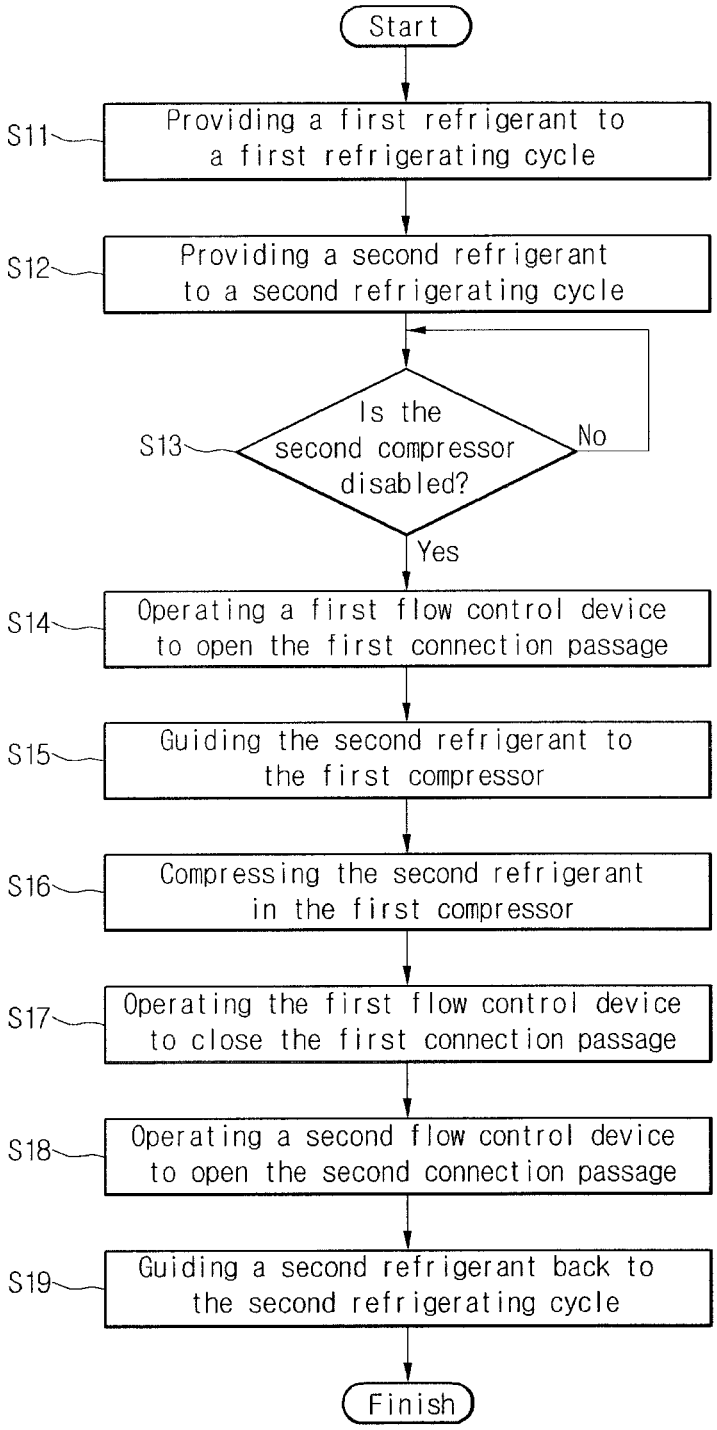
FIG. 13 illustrates a method of operating a refrigerating system, in accordance with embodiments as broadly described herein.

Referring to FIG. 13, the method of operating a refrigerating system comprises providing a first refrigerant to a first refrigerating cycle performed in an air conditioning device including a first compressor (S11), and providing a second refrigerant to a second refrigerating cycle performed in a cooler device including a second compressor (S12), and redirecting a flow of the second refrigerant from the second compressor to the first compressor when the second compressor is disabled and continuing to perform the refrigerating cycle in the cooler using refrigerant compressed by the first compressor (S13).

In detail, redirecting a flow of the second refrigerant comprises guiding the second refrigerant from the second refrigerating cycle to the first refrigerating cycle through a connection passage that connects the first and second refrigerating cycles of the air conditioning device and the cooler device, and guiding the second refrigerant provided from the second refrigerating cycle to the first refrigerating cycle to the first compressor, and compressing the second refrigerant in the first compressor (S16), and thereafter guiding the second refrigerant from the first refrigerating cycle back to the second refrigerating cycle through the connection passage.

The connection passage comprises a first connection passage that guides refrigerant from the second refrigerating cycle to the first refrigerating cycle, and a second connection passage that guides refrigerant from the first refrigerating cycle to the second refrigerating cycle.

Guiding the second refrigerant from the second refrigerating cycle to the first refrigerating cycle comprises operating a first flow control device to open the first connection passage (S14), guiding the second refrigerant from the second refrigerating cycle to the first compressor through the first connection passage (S15), operating the first flow control device to close the first connection passage (S17), operating a second flow control device to open the second connection passage (S18), and guiding the second refrigerant from the first refrigerating cycle back to the second refrigerating cycle through the second connection passage (S19).

A refrigerant system is provided in which a cooling performance thereof is maintained although a cooler-side compressor is abnormally operated.

In one embodiment, a refrigerant system as broadly described herein may include an air conditioner performing a refrigerant cycle for heating and cooling an indoor space, the air conditioner including an air conditioner-side compressor, an air conditioner-side outdoor heat exchanger, an air conditioner-side expansion part, an indoor heat exchanger, and an air conditioner-side refrigerant tube; a cooler performing a refrigerant cycle for cooling foods, the cooler including a cooler-side compressor, a cooler-side outdoor heat exchanger, a cooler-side expansion part, a cooling heat exchanger, and a cooler-side refrigerant tube; and a connection tube connecting the air conditioner-side refrigerant tube to the cooler-side refrigerant tube such that refrigerant flows between the air conditioner and the cooler. Therefore, a cooling performance of the refrigerant system may be maintained although the cooler-side compressor is abnormally operated.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerating system, comprising:

an air conditioner that heats and cools a prescribed space, the air conditioner comprising a first compressor, a first outdoor heat exchanger, a first expansion device, a first indoor heat exchanger, and a first refrigerant passage;

a cooler that provides cooling to storage items, the cooler comprising a second compressor, a second outdoor heat exchanger, a second expansion device, a second indoor heat exchanger, and a second refrigerant passage; and a refrigerant heat exchanger in which refrigerant flowing through the air conditioner is heat exchanged with refrigerant flowing through the cooler, wherein the refrigerant flowing through the air conditioner and the refrigerant flowing through the cooler flow independently, wherein both the first outdoor heat exchanger and the second outdoor heat exchanger are operated as a condenser, and wherein the refrigerant flowing through the air conditioner flows into the first compressor, the first outdoor heat exchanger, the first expansion device and the refrigerant heat exchanger when a flow of refrigerant toward the first indoor heat exchanger is interrupted.

2. The system of claim 1, further comprising a flow interrupter that selectively interrupts a flow of refrigerant toward the first indoor heat exchanger.

3. The system of claim 1, wherein the first indoor heat exchanger is connected in parallel to the refrigerant heat exchanger on the first refrigerant passage.

4. The system of claim 1, wherein the first refrigerant passage comprises:

a first refrigerant tube that connects the first compressor, the first outdoor heat exchanger, and the refrigerant heat exchanger to each other; and a second refrigerant tube that guides refrigerant discharged from the first compressor or the first outdoor heat exchanger to the first indoor heat exchanger.

5. The system of claim 4, wherein the refrigerant within the cooler and the first refrigerant passage flows in a state where a refrigerant flow within the second refrigerant passage is interrupted.

6. The system of claim 1, wherein the air conditioner and the cooler are coupled such that refrigerant flowing into the second compressor is compressed by the first compressor when flow to the second compressor is interrupted.

7. The system of claim 6, wherein the refrigerating system operates in a first mode in which both the first and second compressors are operational, and in a second mode in which one of the first compressor or the second compressor is non-operational.

8. The system of claim 7, wherein refrigerant directed towards the one of the first compressor or the second compressor is re-directed to the other of the first compressor or the second compressor in the second mode such that the refrigerant is compressed in the other of the first or second compressor.

9. The system of claim 6, wherein the first indoor heat exchanger is connected in parallel to the second indoor heat exchanger with respect to the air conditioner.

10. The system of claim 6, further comprising a flow switching device that selectively a flow of refrigerant toward the second compressor.

11. The system of claim 6, wherein the flow switching device is switched in a first position that forms a closed circuit of a refrigerant cycle including the second compressor, or in a second position that forms a closed circuit of a refrigerant cycle including the first compressor.

12. The system of claim 6, wherein the cooler is a refrigerator that performs a refrigerating cycle for storing food items in a refrigerated state or a freezer that performs a refrigerating cycle for storing food items in a frozen state.

* * * * *